US006727852B2

(12) United States Patent
Cheng

(10) Patent No.: US 6,727,852 B2
(45) Date of Patent: Apr. 27, 2004

(54) DUAL BAND MICROSTRIP ANTENNA

(75) Inventor: Yung Chang Cheng, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 118 days.

(21) Appl. No.: 10/033,290

(22) Filed: Dec. 26, 2001

(65) Prior Publication Data

US 2003/0103005 A1 Jun. 5, 2003

(30) Foreign Application Priority Data

Nov. 30, 2001 (TW) ..... 90220793 U

(51) Int. Cl.[7] ..... H01Q 1/38

(52) U.S. Cl. ..... 343/700 MS; 343/702; 343/846

(58) Field of Search ..... 343/700 MS, 702, 343/846, 848

(56) References Cited

U.S. PATENT DOCUMENTS 6,181,281 B1 * 1/2001 Desclos et al. ..... 343/700 MS
6,184,833 B1 * 2/2001 Tran ..... 343/700 MS
6,369,761 B1 * 4/2002 Thiam et al. ..... 343/700 MS
6,483,463 B2 * 11/2002 Kadambi et al. .... 343/700 MS
6,515,625 B1 * 2/2003 Johnson ..... 343/700 MS
6,624,786 B2 * 9/2003 Boyle ..... 343/700 MS
2002/0000938 A1 * 1/2002 Hoashi et al. ..... 343/700 MS

* cited by examiner

*Primary Examiner*—Hoang V. Nguyen
(74) *Attorney, Agent, or Firm*—Wei Te Chung

(57) ABSTRACT

A dual band microstrip antenna (1) has a dielectric substrate (11), a ground plane (10) attached to a bottom surface (111) of the substrate, a first and second radiating patches (21, 22), a first and second conductive posts (23, 24), and a first and second feeder cables (25, 26). The conductive posts each separately elevate a corresponding radiating patch an appropriate height above and parallel to a top surface (110) of the substrate, and electrically connect each radiating patch to the ground plane. Feeder inner conductors (250, 260) are soldered to their respective radiating patches and feeder outer conductors (251, 261) are soldered to the ground plane. Impedance matching is achieved by selecting an appropriate distance between the solder positions of the posts and inner conductors on each radiating patch.

13 Claims, 4 Drawing Sheets

DUAL BAND MICROSTRIP ANTENNA

FIELD OF THE INVENTION

The present invention relates to a dual band microstrip antenna.

BACKGROUND OF THE INVENTION

In a modern office environment, wireless local access networks (WLAN) are more and more common. Such a WLAN usually uses many antennas to transmit and receive data. IEEE 802.11a (5.2 GHz) and IEEE 802.11b (2.4 GHz) are two widely used standards for WLANs. In a WLAN employing the above-mentioned two standards, dual band antennas are needed.

Among the many types of dual band antennas available, microstrip antennas are widely used for their low profiles and good gains, particularly since they are easy to be built into other equipment.

A conventional dual band microstrip antenna is disclosed in U.S. Pat. No. 5,561,435. Referring to FIG. 1, the dual band microstrip antenna comprises a first, second and third superimposed dielectric layers 4', 6', 16', a ground plane 2' on one external surface, a radiating patch 18' on the other, and parallel conductive strips 12', 14' at the interface of the dielectric layers 6', 16', closer to the radiating patch 18' than to the ground plane 2'. The dielectric constant of the second dielectric layer 6' is different from that of the first and third dielectric layers 4', 16'. A feeder (not labeled) is electrically connected to the dual band microstrip antenna with an inner conductor soldered to the radiating patch 18' and an outer conductor soldered to the ground plane 2'. By properly choosing the thicknesses and the dielectric constants of the dielectric layers 4', 6', 16', the dual band microstrip antenna can be made to work in two different frequency bands. Matching the line impedance to the antenna impedance in the high frequency band can be achieved by adjusting a soldering position of the inner conductor on the radiating patch 18'. Matching the line impedance to the antenna impedance in the low frequency band can be achieved by adjusting positions of the two conductive strips 12', 14'.

However, the dual band microstrip antenna mentioned above can not work in two different frequency bands at the same time. Additionally, manufacturing the multiple dielectric layers is costly. Furthermore, achieving impedance matching in the two different frequency bands adds to the difficulty of manufacturing.

Hence, an improved dual band microstrip antenna is desired to overcome the above-mentioned shortcomings of existing dual band microstrip antennas.

BRIEF SUMMARY OF THE INVENTION

A primary object, therefore, of the present invention is to provide a dual band microstrip antenna that can work in two different frequency bands at the same time.

Another object of the present invention is to provide a dual band microstrip antenna with a simple structure and low cost.

A dual band microstrip antenna in accordance with the present invention comprises a dielectric substrate, a ground plane attached to a bottom surface of the substrate, a first and second radiating patches separately elevated an appropriate height above and parallel to a top surface of the substrate, a first and second conductive posts respectively elevating the first and second radiating patches above the substrate and electrically connecting the first and second radiating patches with the ground plane, and a first and second feeder cables. Inner conductors and outer conductors of the feeder cables are respectively electrically connected to corresponding radiating patches and to the ground plane.

Other objects, advantages and novel features of the invention will become more apparent from the following detailed description of a preferred embodiment when taken in conjunction with the accompanying drawings. A copending application filed on the same date with the invention titled "METHOD OF MAKING DUAL BAND MICROSTRIP ANTENNA" is referenced hereto.

DETAILED DESCRIPTION OF THE INVENTION

Figure 1:
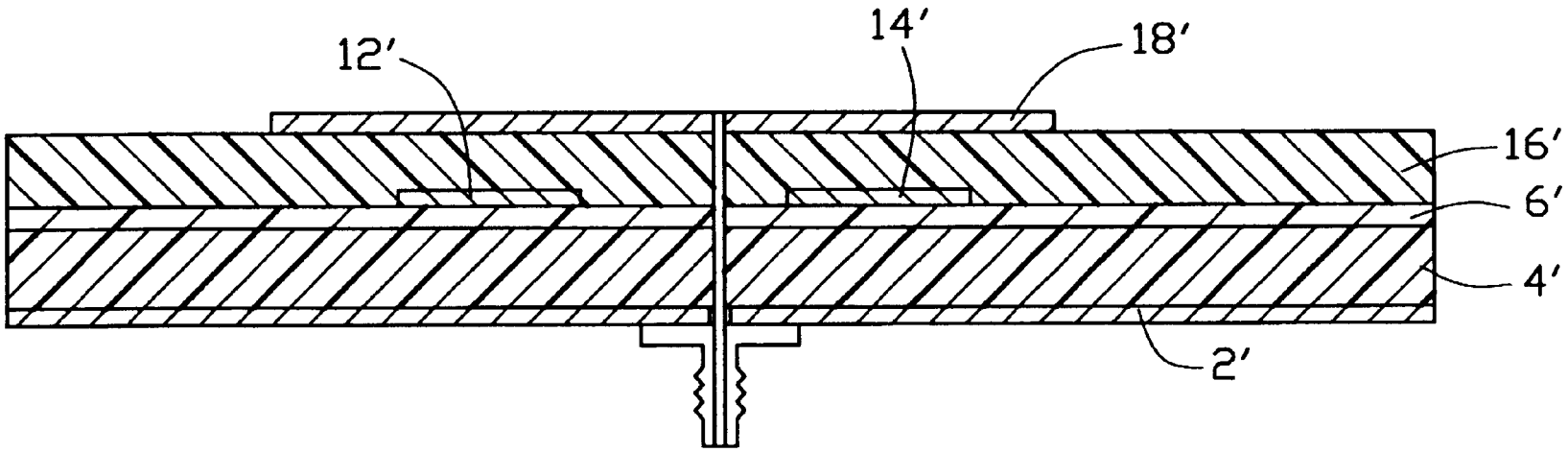
FIG. 1 (PRIOR ART)
FIG. 1 is a cross-sectional view of a conventional dual band microstrip antenna.
Figure 2:
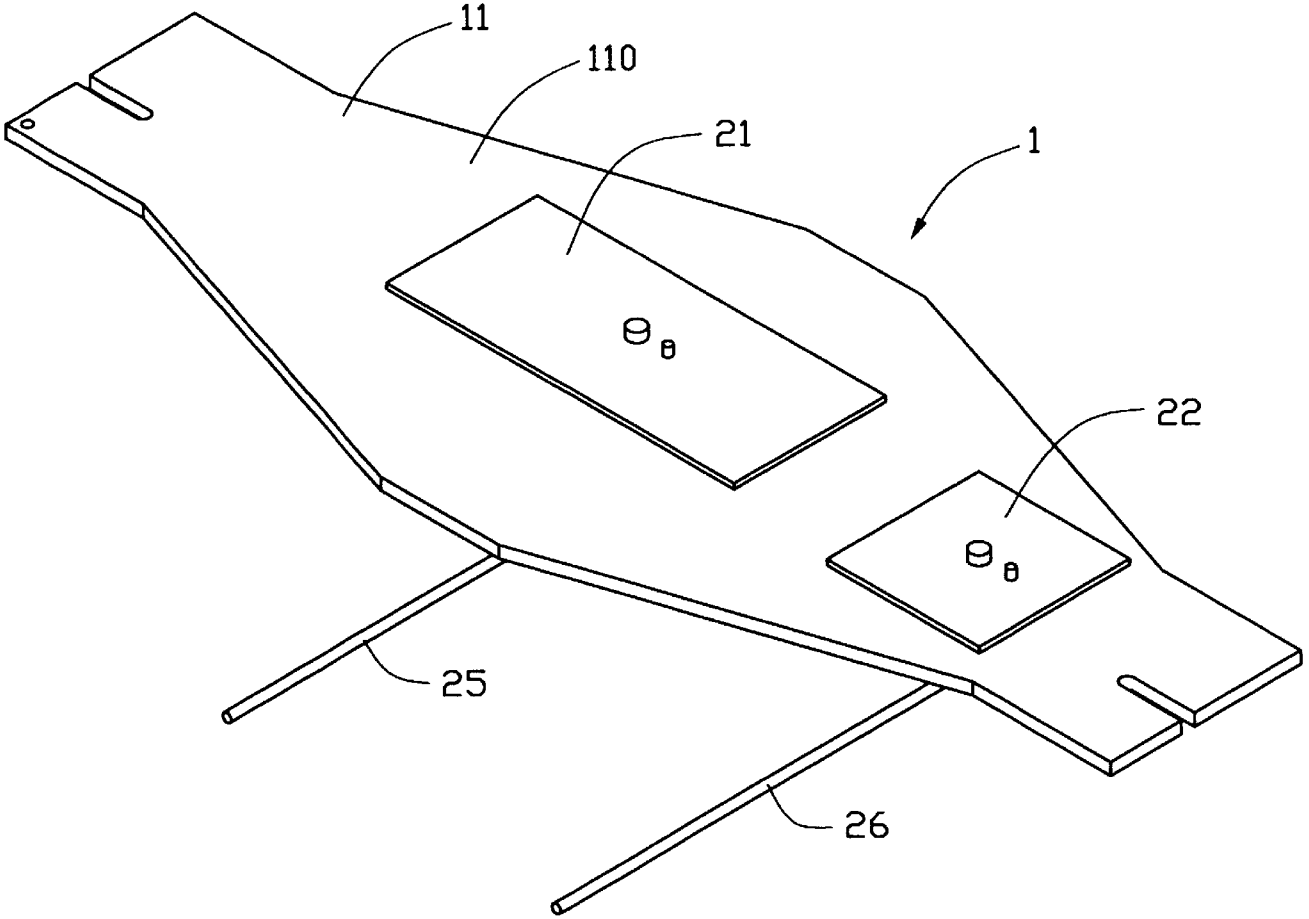
FIG. 2 is an perspective view of a dual band microstrip antenna in accordance with the present invention.
Figure 3:
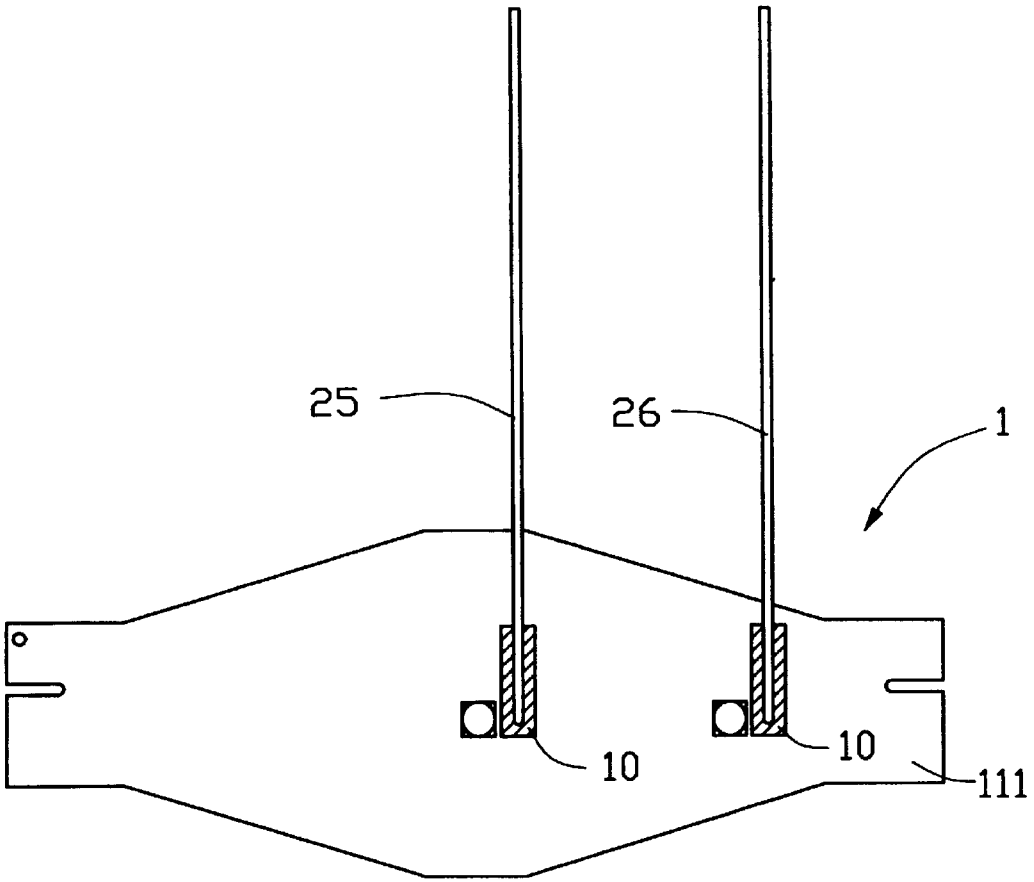
FIG. 3 is a bottom view of the dual band microstrip antenna of FIG. 2.

Reference will now be made in detail to a preferred embodiment of the present invention.

Referring to FIGS. 2–5, a dual band microstrip antenna 1 in accordance with the present invention comprises a dielectric substrate 11, conductive first and second radiating patches 21, 22, first and second conductive posts 23, 24, a ground plane 10 and a first and second feeder cables 25, 26.

In this embodiment, the dielectric substrate 11 is substantially a diamond shape printed circuit board made of FR4 material, namely FR4 PCB. The dielectric substrate 11 has a pair of parallel major surfaces, respectively named a top surface 110 and a bottom surface 111. The ground plane 10 is attached to the bottom surface 111 and is overcoated with a layer of green lacquer, leaving a plurality of tin areas (represented by inclined lines in FIG. 3) exposed for soldering.

The first and second radiating patches 21, 22 are each separately elevated appropriate height above the top surface 110 of the dielectric substrate 11 by the first and second conductive posts 23, 24. Each of the first and second radiating patches 21, 22 is parallel to the top surface 110. A length of the first radiating patch 21 corresponds to a low frequency wavelength scale, and a length of the second radiating patch 22 corresponds to a high frequency wavelength scale, the low and high frequencies being 2.4 GHz and 5.2 GHz, for example. In other words, the length of the first radiating patch 21 is chosen so that the first radiating patch 21 electromagnetically resonates at 2.4 GHz, and the length of the second radiating patch 22 is chosen so that the second radiating patch 22 resonates at 5.2 GHz. The first conductive post 23 is perpendicular to both the first radiating patch 21 and the ground plane 10 and electrically connects them together at soldering points. The second conductive post 24 is perpendicular to both the second radiating patch 22 and the ground plane 10 and electrically connects them together at soldering points.

The first and second feeder cables 25, 26 are each coaxial cables respectively having a first and second inner conductors 250, 260 each surrounded by a dielectric layer (not labeled) which are each surrounded by a respective first and second outer conductor 251, 261. The first outer conductor 251 is soldered to a corresponding tin area on the ground plane 10 while the first inner conductor 250 passes through the dielectric substrate 11 and is soldered to the first radiating patch 21. The second outer conductor 261 is soldered to a corresponding tin area on the ground plane 10 while the second inner conductor 260 also passes through the dielectric substrate 11 and is soldered to the second radiating patch 22.

Figure 4:
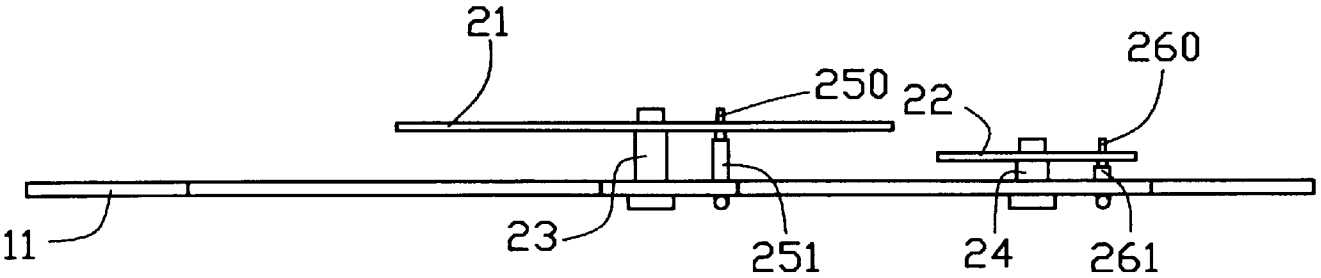
FIG. 4 is a front view of the dual band microstrip antenna of FIG. 2.
Figure 5:
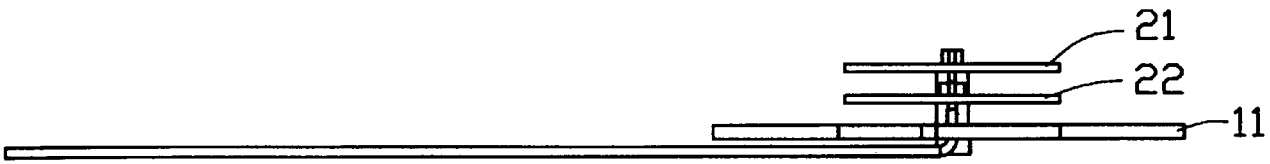
FIG. 5 is a side view of the dual band microstrip antenna of FIG. 2.

Particularly referring to FIG. 4, the matching impedance between the first radiating patch 21 and the first feeder cable 25 can be achieved by adjusting a distance between soldering positions of the first inner conductor 250 and the first conductive post 23 on the first radiating patch 21. The matching impedance between the second radiating patch 22 and the second feeder cable 26 can be achieved by adjusting a distance between soldering positions of the second inner conductor 260 and the second conductive post 24 on the second radiating patch 22. The first and second radiating patches 21, 22 respectively operate in the low and high frequency bands.

The dual band microstrip antenna 1 is simple in design, is easy and inexpensive to manufacture, and can operate in two different frequency bands at the same time.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A dual band microstrip antenna, comprising:

a dielectric substrate;

a ground plane attached to a bottom surface of the substrate;

a first and a second radiating patches each separately elevated an appropriate height above and parallel to a top surface of the substrate;

a first and a second conductive posts providing the function of elevating the first and second radiating patches, respectively, above the top surface of the substrate, while also electrically connecting the first and second radiating patches, respectively, with the ground plane; and a first and second feeder cables both including, respectively, a first and second inner conductors, each surrounded by an insulative layer, and a first and second outer conductors covering the insulative layer;

wherein the first and second inner conductors are each respectively electrically connected to said first and second radiating patches and the first and second outer conductors are electrically connected to the ground plane.

2. The dual band microstrip antenna as claimed in claim 1, wherein lengths of said first and second radiating patches respectively correspond to two different frequency wavelength scales.

3. The dual band microstrip antenna as claimed in claim 2, wherein said two different frequencies are respectively 2.4 GHz and 5.2 GHz.

4. The dual band microstrip antenna as claimed in claim 1, wherein said first and second inner conductors of said first and second feeder cables are soldered to respective first and second radiating patches, with soldering positions being selected to achieve a matching impedance between each feeder cable and a corresponding radiating patch.

5. The dual band microstrip antenna as claimed in claim 1, wherein said conductive posts are perpendicular to the radiating patches and to the ground plane.

6. A microstrip antenna comprising a dielectric substrate defining opposite top and bottom surfaces thereon, a ground plane formed on one of said top and bottom surfaces of the substrate, at least a radiating patch elevated an appropriate height above and essentially parallel to a top surface of the substrate, at least a conductive post electrically connecting the radiating patch with the ground plane, and at least a feeder cable having an outer conductor electrically connected to the ground plane and an inner conductor passing through the substrate and electrically connected to the radiating patch.

7. The microstrip antenna as claimed in claim 6, wherein a length of said radiating patch corresponds to a working frequency wavelength scale.

8. The microstrip antenna as claimed in claim 6, wherein said inner conductor of said feeder cable is soldered to said radiating patch, with a soldering position being selected to achieve an impedance matching of the feeder cable to the radiating patch in said working frequency band.

9. The microstrip antenna as claimed in claim 6, wherein said conductive post is perpendicular to said radiating patch and to the ground plane.

10. The microstrip antenna as claimed in claim 6, wherein said post provides mechanical support of the radiating patch elevated from said substrate.

11. A dual band microstrip antenna comprising:

a dielectric substrate defining opposite top and bottom surfaces thereon;

a ground plane provided on one of said top and bottom surfaces of said substrate;

first and second radiating patches mutually independently elevated from said top surface; and first and second feeder cables respectively connecting to both the corresponding radiating patch and the ground plane; wherein each of said first and second feeder cables extends from the bottom surface through the substrate and beyond the top surface, and includes a top portion located above said top surface and defining an inner conductor surrounded by an outer conductor, said inner conductor connecting to said radiating patch and said outer conductor electrically connecting to said grounding plane.

12. The dual band microstrip antenna as claimed in claim 11, wherein said first radiating patch and said second radiating patch are spaced from each other in a horizontal direction.

13. The dual band microstrip antenna as claimed in claim 11, wherein said first feeder cable and said second feeder cable share the same ground plane.

* * * * *